United States Patent [19]

Dumbaugh et al.

[11] 4,224,006

[45] Sep. 23, 1980

[54] HOPPER CAR DISCHARGE APPARATUS

[75] Inventors: George D. Dumbaugh, Louisville; Paul A. Wilson, Saint Matthews, both of Ky.

[73] Assignee: Vibranetics, Inc., Louisville, Ky.

[21] Appl. No.: 946,576

[22] Filed: Sep. 28, 1978

[51] Int. Cl.[3] ..... B65G 67/24

[52] U.S. Cl. ..... 414/375; 414/572

[58] Field of Search ..... 414/375, 373, 376–378, 414/390, 401, 403, 415, 572; 366/128; 222/196, 199, 200, 161; 92/39, 34; 180/24.02

[56] References Cited

U.S. PATENT DOCUMENTS

| | | | |
|---|---|---|---|
| 2,818,184 | 12/1957 | Matson | 414/375 |
| 3,047,169 | 7/1962 | Matson | 414/375 |
| 3,133,652 | 5/1964 | Musschoot | 414/375 X |
| 3,407,670 | 10/1968 | Venanzetti | 366/128 X |
| 3,744,676 | 7/1973 | Dumbaugh | 222/161 |
| 3,860,256 | 1/1975 | Jackson et al. | 180/24.02 X |
| 3,870,336 | 3/1975 | Bilas | 180/24.02 X |

*Primary Examiner*—Stephen G. Kunin
*Assistant Examiner*—Edmond G. Rishell, Jr.
*Attorney, Agent, or Firm*—Harry B. O'Donnell, III

[57] ABSTRACT

This invention provides novel apparatus for accelerating the emptying of railroad hopper cars and the like. The invention comprises: a rigid frame fixedly mountable through a base to a pair of generally horizontally-spaced-apart rails upon which the wheels of a railroad hopper car can be movably supported, with the frame including an upright section from which there generally horizontally extends towards the rails a hollow spool connected to a vented source of pressurized fluid; and an excitor connected to the spool through an inflatable yieldably resilient sleeve that performs dual functions of moving the excitor generally horizontally with respect to the frame into and out of contact with a side of the hopper car and also vibration isolating the excitor from the frame. The novel apparatus further includes a stabilizer mechanism connected between the excitor and frame for multi-directional movement relative thereto, with the frame including a second section which is vertically spaced apart from the spool and extends generally horizontally from the upright section of the frame toward the rails and with the stabilizer mechanism comprising a rigid link connected at each of its opposite ends between the second section of the frame and the excitor through a vibration isolating member having a rigid central portion and hollow end portions at opposite ends thereof, each of which is lined with a yieldably resilient material and has a central bore that is offset by substantially a right angle from that of the other.

7 Claims, 4 Drawing Figures

HOPPER CAR DISCHARGE APPARATUS

BACKGROUND OF THE INVENTION

This invention relates to apparatus for accelerating the emptying of railroad hopper cars and the like, such as are commonly used to transport coal, ore and similar materials.

Railroad hopper cars are commonly equipped with sloping bottoms and closure gates beneath them, with the gates being opened to permit gravity-influenced discharge of the contents of the car when so desired. In spite of the provision of the sloping car bottoms, the material to be discharged, whether it be coal, ore, or other similar material, often does not flow freely and continuously under the influence of gravity alone, but tends to bridge over the discharge openings from time to time, requiring considerable manual labor to free it and to complete emptying of the car.

In the past, various forms of old mechanical apparatus have been provided for accelerating the emptying of railroad hopper cars and the like and, thus, supplementing or reducing the amount of manual labor required to augment the aforenoted gravity-influenced discharge of material from such hopper cars.

U.S. Pat. No. 2,504,789 shows and describes an extremely mechanically complex, and hence quite expensive, form of such prior-art apparatus which has been manufactured and sold by Hewitt-Robins, Inc. since the early 1950s. While this particular form of prior-art apparatus has provided satisfactory results in accelerating the emptying of railroad hopper cars, it has the disadvantage of requiring a costly overhead structure and a crane or hoist to move it about with respect to the hopper cars. This form of apparatus is commonly referred to as an "over-the-track car shaker".

In an apparent attempt to reduce equipment cost when compared to the just-described form of prior-art apparatus, Hewitt-Robins, Inc. has also provided a later form of prior-art apparatus, such as that shown and described in its Bulletin No. 187*a*-5-G-766, which bears a 1963 claim of copyright. This later prior-art form of apparatus eliminates the aforenoted overhead structure and crane or hoist, and comprises frame means that are mountable through base means to a pair of generally-horizontally-spaced apart rails upon which the wheels of a railroad hopper car can be supported. The frame means is mounted next to one side of the rails and has connected to it, via a parallelogram linkage, an excitor means that is movable by a hydraulic fluid-cylinder motor into and out of contact with one vertical side of the hopper car. This prior-art form of apparatus is commonly referred to as "trackside car shaker" and its excitor means comprises a single hydraulic motor that is mounted to plate means, one face of which contacts the one vertical side of the hopper car and the other face of which is connected by vibration isolating springs to the aforenoted parallelogram linkage.

While the latter one of the two aforedescribed forms of prior-art apparatus offers an equipment requirement reduction over the former, it usually does not equal its performance in accelerating the emptying of railroad hopper cars and the like.

The present invention is directed toward providing a novel apparatus for accelerating the emptying of railroad hopper cars and the like, which is somewhat similar to the latter one of the two aforedescribed forms of prior-art apparatus, but which offers yet a further reduction in equipment required, while improving upon the performance of such a "trackside car shaker".

SUMMARY OF THE INVENTION

The present invention provides novel and improved apparatus for accelerating the emptying of railroad hopper cars and the like.

Basically, the improved apparatus that is provided in accordance with the present invention comprises: rigid frame means fixedly mountable through base means to a pair of generally horizontally-spaced-apart rails upon which the wheels of a railroad hopper car can be movably supported, with the frame means including an upright section from which there generally horizontally extends towards the rails hollow spool means that can be fluid connected to a source of pressurized fluid and also can be vented of the pressurized fluid through valve means; and excitor means connected to the spool means through inflatable yieldably resilient sleeve means that perform dual functions of moving the excitor means generally horizontally with respect to the frame means into and out of contact with a side of the hopper car and also vibration isolating the excitor means from the frame means.

Preferably, the inflatable yieldably resilient sleeve means comprises a pair of bellows and the excitor means comprises a pair of motors, with each of the motors having a generally vertically-arranged output shaft eccentrically mounting weight means on its opposite ends and with each shaft being rotatable in a direction opposite from that of the other shaft, and with one of the bellows being positioned between the frame means and one of the motors and the other of the two bellows being positioned between the frame means and the other one of the two motors.

It is further desirable that the improved apparatus further includes stabilizer means connected between the excitor means and frame means for multi-directional movement relative thereto, with said frame means including a second section which is vertically spaced apart from the spool means and extends generally horizontally from the upright section of the frame means toward the rails and with the stabilizer means comprising linkage means mounted between the second section of the frame means and the excitor means that include vibration isolating members having a rigid central portion and hollow end portions at opposite ends thereof, each of which is lined with a yieldably resilient material and has a central bore that is offset by substantially a right angle from that of the other. It is still further to be preferred that one of the central bores be aligned generally parallel to the long central axis of the sleeve means and that the other one of the central bores be aligned generally parallel to the long central axis of hopper car-contacting elastomeric bumper means that are mounted on the side of the excitor means opposite from the sleeve means.

BRIEF DESCRIPTION OF THE DRAWINGS

The present invention is illustrated in the accompanying drawings, wherein.

DETAILED DESCRIPTION

Figure 3:
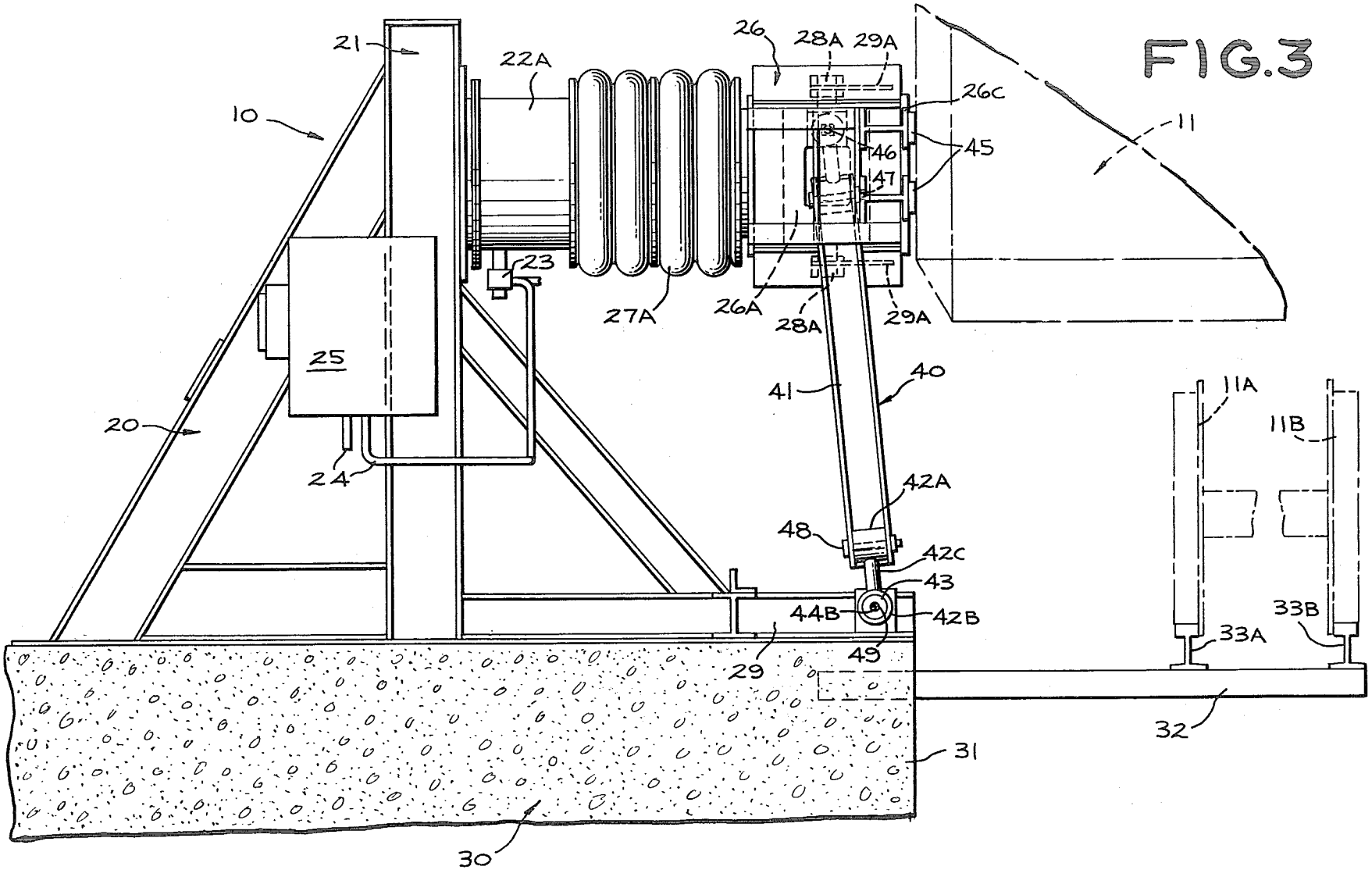
FIG 3, is a somewhat schematic, fragmentary, left-end elevational view of the form of the apparatus shown in FIGS. 1 and 2, with the inflatable yieldably resilient sleeve means being illustrated in an inflated condition to thus cause the excitor means and the bumper means therefor to be thereby held in contact with one vertical side of a railroad hopper car and with the apparatus being shown in solid lines and the railroad hopper car being shown in shadow lines.
Figure 4:
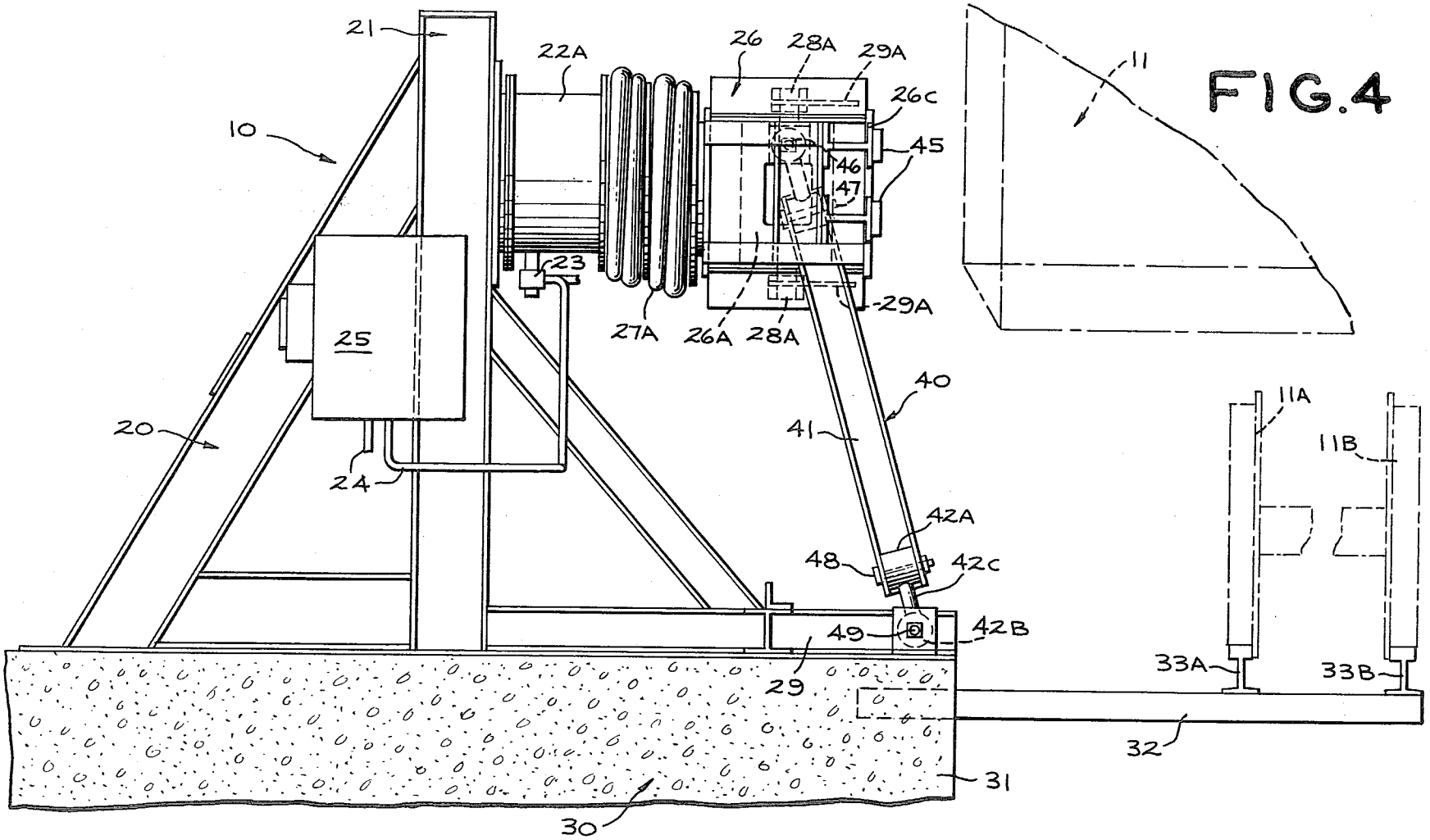
FIG. 4 is a somewhat schematic, fragmentary, left-end elevational view of the form of the apparatus shown in FIGS. 1–3, but illustrating the inflatable yieldably resilient sleeve means in a deflated condition.

Turning now to the drawings, and more particularly to FIGS. 1–4 thereof, there is illustrated a presently preferred form of a novel and improved apparatus 10 that is provided in accordance with the present invention for accelerating the emptying of a railroad hopper car, such as the hopper car 11 (partly shown in shadow lines in FIGS. 3 and 4).

As illustrated in FIGS. 1–4 of the drawings, the novel and improved apparatus 10 of the present invention basically comprises: rigid frame means 20 that are fixedly mountable, by well-known fastener means (not shown) through base means 30, such as the illustrated concrete pad 31 and plate 32 which is set therein, to a pair of generally horizontally-spaced-apart rails 33A and 33B upon which the wheels 11A and 11B (shown in shadow lines of FIGS. 3 and 4) of the railroad hopper car 11 can be movably supported, with the frame means 20, including an upright section 21 from which there generally horizontally extends towards the rails 11A and 11B hollow spool means including a pair of rigid spools 22A and 22B that are rigidly fastened thereto by well-known fastener means (not shown) and that can be fluid-connected by valve means 23 and suitable conduit means 24 to a source of pressurized fluid 25, such as the holding tank illustrated in drawing FIGS. 3 and 4, and can also be vented of the pressurized fluid through the valve means 23; and excitor means 26, comprising a pair of electrically-powered motors 26A and 26B which are mounted on a common bracket 26C that is, in turn, respectively connected to the two spools 22A and 22B through inflatable yieldably resilient sleeve means which, as illustrated in the drawings, preferably comprises a pair of bellows 27A and 27B that perform dual functions of moving the excitor means 26 generally horizontally with respect to the frame means 20 into (FIG. 3) and out of (FIG. 4) contact with one of the long vertical sides of the hopper car 11, and also vibration isolating the excitor means 26 from the frame means 20.

From the foregoing description, it should be apparent that, while the novel apparatus 10 that is provided in accordance with the present invention is somewhat similar to the aforenoted prior-art form of such apparatus that is commonly referred to as a "Hewitt-Robins trackside car shaker", it does, indeed, possess important structural differences over that prior-art form, in that, among other things, it employs common means—its inflatable yieldably resilient sleeve means (such as its bellows 27A and 27B)—to perform dual functions of: (1) moving its excitor means 26 generally horizontally with respect to its frame means 20 into and out of contact with the side of the hopper car 11; and (2) also vibration isolating its excitor means 26 from its frame means 20, whereas, that prior-art form of apparatus required separate means to perform each of those two functions, to wit, at least one hydraulic fluid-cylinder motor to perform the first of said two functions and plural springs to perform the second of said two functions. Hence, it should be amply clear that the novel apparatus 10 that is provided in accordance with the present invention provides yet a further reduction in equipment required over both of the aforedescribed prior-art forms of such apparatus.

Figure 1:
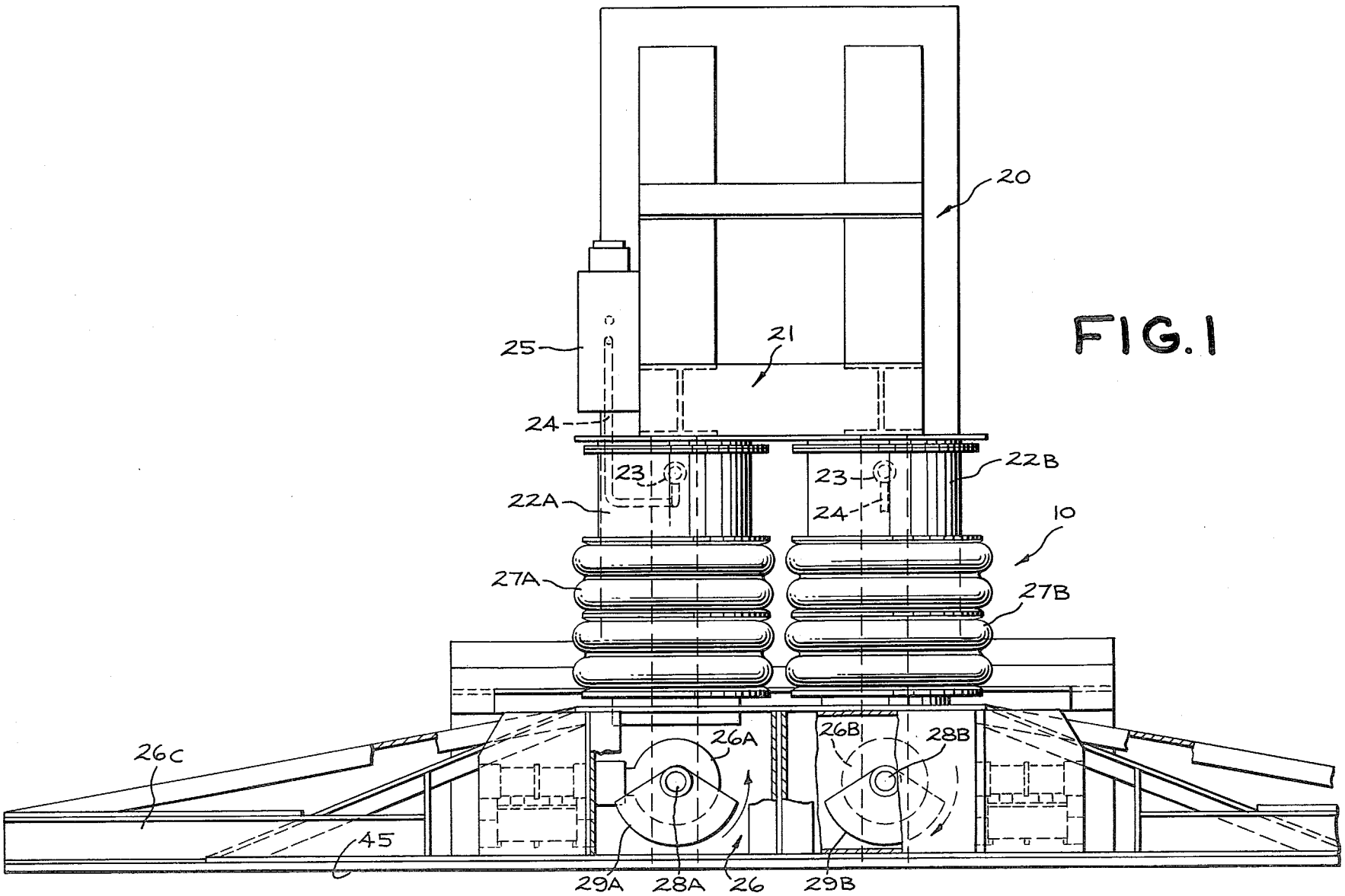
FIG. 1 is a somewhat schematic, partly-broken, fragmentary, top plan view of a presently preferred form of the novel and improved apparatus that is provided in accordance with the present invention.
Figure 2:
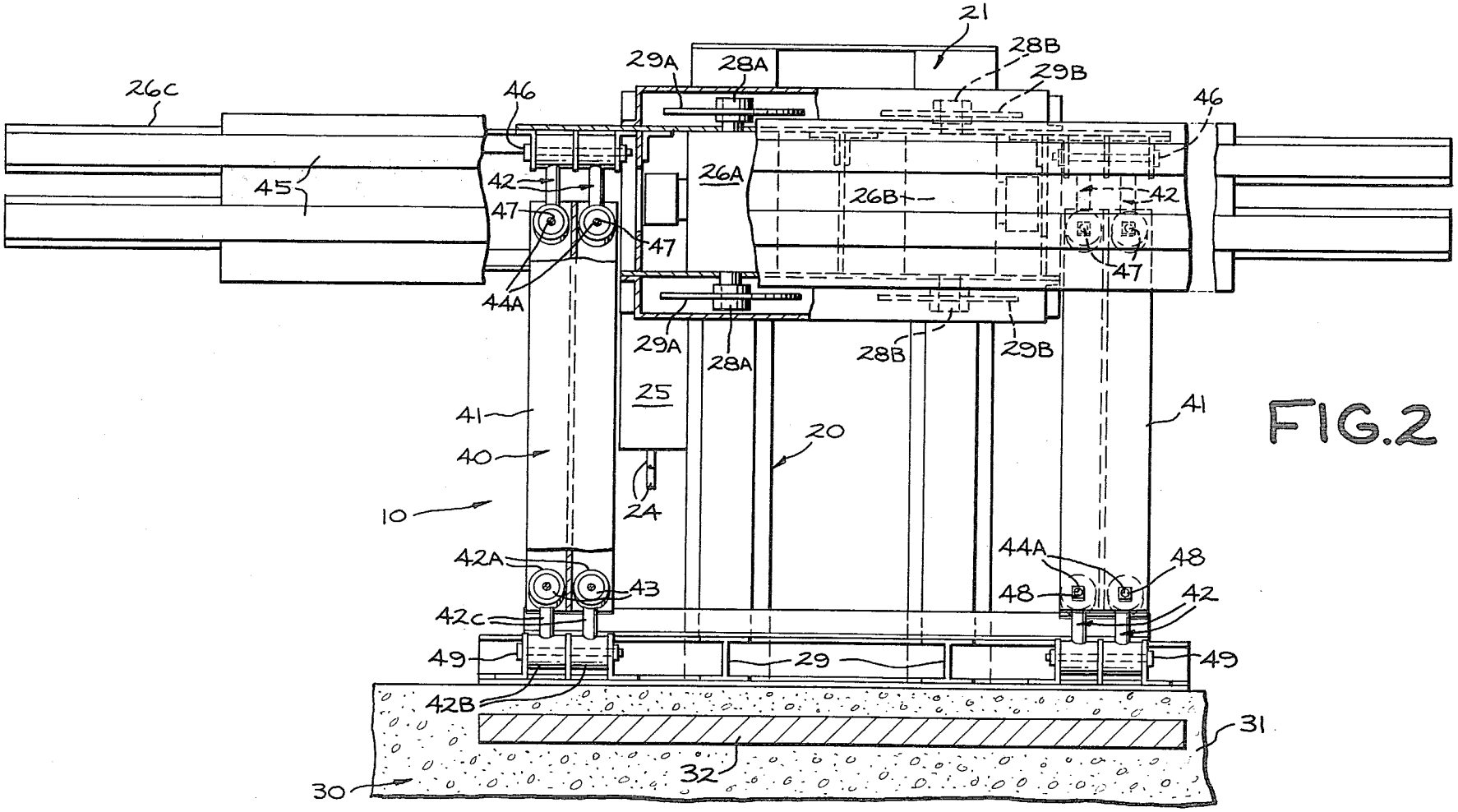
FIG. 2 is a somewhat schematic, partly-broken, fragmentary, front elevational view of the form of the apparatus shown in FIG. 1.

As further shown in the drawings, each of the two motors 26A and 26B of the excitor means for the novel apparatus 10 of the present invention preferably has a generally vertical-arranged output shaft 28A and 28B and weight means 29A and 29B are respectively eccentrically mounted on the opposite ends thereof, with each of the two shafts 28A and 28B being rotatable in a direction opposite from that of the other (note especially the directional arrows so indicating this in FIG. 1) and with one of the two bellows 27A being positioned between the frame means 20 and a first one of the two motors 26A and one other of the two bellows 27B being positioned between the frame means 20 and the other one of the two motors 26B.

As still further illustrated in the drawings, it is also desirable that the improved apparatus 10 of the present invention include stabilizer means 40 connected between the excitor means 26 and the frame means 20 from multi-directional movement relative thereto, with the frame means 20 including a second section 29 that is vertically-spaced apart from the spool means 22A and 22B and extends generally horizontally from the upright section 21 of the frame means 20 toward the rails 33A and 33B. And, as additionally shown in the drawings, the stabilizer means 40 of the novel apparatus 10 of the present invention preferably comprises linkage means which include two rigid links 41 that are each connected at their opposite ends between the second section 29 of the frame means 20 and the excitor means mounting bracket 26C by a pair of vibration isolating members 42, such as those which have been previously shown and described in detail in U.S. Pat. No. 3,744,676.

As yet further shown in the drawings, each of the eight vibration isolating members 42 for the stabilizer means 40 of the novel apparatus 10 of the present invention includes a rigid central portion 42C and first and second hollow end portions 42A and 42B located at opposite ends thereof. And, each of those hollow end portions 42A and 42B is lined with a yieldably resilient material 43, such as a suitable elastomeric compound, and, respectively, has a central bore 44A and 44B, one of which is offset by substantially a right angle from that of the other.

As even further shown in the drawings, the long central axis of one of the two central bores 44A of each of the eight vibration isolating members 42 is aligned generally parallel to the long central axes of the bellows 27A and 27B, while the long central axis of the opposite one of these two central bores 44B is aligned generally parallel to the long central axis of the hopper-car contacting elastomeric bumber means 45 that are fixedly mounted on the side of the excitor means mounting bracket 26C opposite from the bellows 27A and 27B with the long central axis thereof intended to be co-planar with the one long side of the hopper car 11 which the outer surface of the bumper means 45 is intended to engage. The central bores 44B of each of the upper four of the eight vibration isolating members 42 are pivotally connected by bolts 46 to the excitor means mounting bracket member 26C, while their opposite central bores 44A are connected by bolts 47 to the upper ends of the rigid links 41. And, the central bores 44A of each of the lower four of the eight vibration isolating members 42 are connected by bolts 48 to the lower ends of the rigid links 41, while their opposite central bores 44B are pivotally connected by bolts 49 to the second section 29 of the frame means 20.

OPERATION

To utilize the novel apparatus of the present invention to accelerate the unloading of a railroad hopper car, the operator first aligns the fore-and-aft center of the hopper car, such as the hopper car 11, generally along a line passing centrally and longitudinally between the long central axes of the rigid spools 22A and 22B of the apparatus 10.

Next, of course, the operator opens the discharge gates located on the bottom of the hopper car.

Then, the operator positions the valve means 23 of the apparatus 10 to admit sufficient pressurized fluid from the holding tank 25 therefor and into the spool means 22A and 22B to fully inflate both of the bellows 27A and 27B which are, respectively, fluid-connected thereto, and thus move the excitor means 26 into the position shown in FIG. 3, wherein its bumper means 45 are most firmly engaged in contact with the nearest generally vertically-arranged long side of the hopper car 11.

Next, the operator energizes both of the excitor means motors 26A and 26B, preferably with the output shafts 28A and 28B thereof being caused to rotate in opposite directions from one another (as shown by the directional arrows in FIG. 1), whereupon the rotary action of the motor shafts 28A and 28B and of the weight means 29A and 29B that are eccentrically mounted on the opposite ends thereof will impart a vigorous vibratory action upon the hopper car 11 that will, shortly, cause the remaining contents thereof to be discharged therefrom.

Upon observing completion of the desired degree of emptying of the hopper car 11, the operator de-energizes both of the excitor means motos 26A and 26B and actuates the valve means 23 to vent the pressurized fluid from both of the spools 22A and 22B and, of course, from both of the bellows 27A and 27B that are fluid-connected thereto, thus deflating the bellows 27A and 27B and causing the excitor means 26 to move out of contact with the side of the hopper car 11 and into the retracted position shown in FIG. 4.

Finally, the now fully-emptied hopper car 11 is moved away along the rails 33A and 33B to a point remote from the apparatus 10 and the aforedescribed operation can now be repeated with yet another hopper car which requires emptying.

The stabilizer means 40 of the novel and improved apparatus 10 of the present invention are beneficial in supporting the excitor means 26, whether it be located in its extended position, engaging the side of the hopper car 11 (FIG. 3) or in its retracted position, disengaged from the hopper car 11 (FIG. 4). In either condition, the stabilizer means 40, because of the unique construction of its linkage means which employs both the rigid links 41 and the unique "offset-ended" vibration isolating members 42, permits multi-directional movement of the excitor means 26 and the mounting bracket 26C therefor.

Thus, when the excitor means 26 is engaged with the hopper car 11 (FIG. 3), the unique stabilizer means 40 permit the hopper car 11 to be jarred on the rails 33A and 33B, which sometimes occurs when the locomotive is connecting or disconnecting cars, without disturbing the firm engagement of the excitor means 26 with the hopper car 11. Furthermore, it also allows the excitor means motors 26A and 26B to operate "out of phase", as they will be for a few milliseconds following their energization, until their eccentrically-mounted weights 29A and 29B commence to "phase", without damaging the apparatus 10.

On the other hand, the unique stabilizer means 40 holds the excitor means 26 and the mounting bracket 26C therefor reasonably constrained, in the event that the excitor means motors 26A and 26B should be inadvertently energized while the apparatus 10 is in its retracted position, disengaged from the hopper car 11 (FIG. 4).

It should be apparent that while there has been described what is presently considered to be a presently preferred embodiment of the present invention in accordance with the Patent Statutes, changes may be made in the disclosed apparatus without departing from the true spirit and scope of this invention. It should also be most clearly understood that the aforedescribed pressurized fluid, which is illustrated in the drawings as being stored in the holding tank 25, may be either a hydraulic fluid, such as water, oil, or the like, or a pneumatic fluid, such as air or various other gases and the like. It is, therefore, intended that the appended claims shall cover such modifications and applications that may not depart from the true spirit and scope of the present invention.

What is claimed is:

1. Improved apparatus for accelerating the emptying of railroad hopper cars and the like, comprising:

(a) rigid frame means fixedly mountable through base means to a pair of horizontally-spaced-apart rails upon which the wheels of a railway hopper car can be movably supported, (b) said frame means including an upright section from which there generally horizontally extends toward the rails hollow spool means that can be fluid-connected to a source of pressurized fluid and also can be vented of said pressurized fluid through valve means;

(c) excitor means connected to said spool means through inflatable yieldably resilient sleeve means that perform dual functions of moving said excitor means generally horizontally with respect to said frame means into and out of contact with a side of the hopper car and also vibration isolating said excitor means from said frame means; and (d) stabilizer means connected between said excitor means and said frame means and having the capacity for multi-direction movement, (e) said frame means including a second section which is vertically spaced apart from said spool means and extends generally horizontally from said upright section towards said rails, and (f) said stabilizer means comprising linkage means including a rigid link connected at each of its opposite ends between said second section of said frame means and said excitor means through a vibration isolating member having a rigid central portion and hollow end portion at opposite ends thereof, each of which is lined with a yieldably resilient material and has a central bore offset by a right angle from that of the other.

2. The apparatus of claim 1, wherein said excitor means comprises motor means having generally vertically-arranged output shaft means, with weight means being eccentrically mounted on at least one of the opposite ends of said output shaft means.

3. The apparatus of claim 1, wherein said excitor means comprises a pair of motors, with each of said motors having a generally vertically-arranged output shaft eccentrically mounting weight means on its opposite ends and with each said shaft being rotatable in a direction opposite from that of the other said shaft.

4. The apparatus of claim 3, wherein said inflatable yieldably resilient means comprises a pair of bellows, with one of said bellows being positioned between said frame means and one of said motors and the other of said bellows being positioned between said frame means and the other one of said motors.

5. The apparatus of claim 1, wherein said inflatable yieldably resilient sleeve means comprises bellows means.

6. The apparatus of claim 1, wherein one of said central bores is aligned generally parallel to the long central axis of said sleeve means.

7. The apparatus of claim 6, wherein the other one of said central bores is aligned generally parallel to the long central axis of hopper car-contacting elastomeric bumper means that are mounted on the side of said excitor means opposite from said sleeve means.

* * * * *